US005986251A

United States Patent [19]

Kang et al.

[11] Patent Number: 5,986,251

[45] Date of Patent: Nov. 16, 1999

[54] MICROWAVE OVEN MAIN BODY STRUCTURE

[75] Inventors: Jong-Soo Kang; Dong-Wan Seo, both of Changwon, Rep. of Korea

[73] Assignee: LG Electronics, Inc., Rep. of Korea

[21] Appl. No.: 09/193,013

[22] Filed: Nov. 16, 1998

[30] Foreign Application Priority Data

Nov. 15, 1997 [KR] Rep. of Korea ..... 97-60239

[51] Int. Cl.[6] ..... H05B 6/80

[52] U.S. Cl. ..... 219/756; 219/738; 126/273 R

[58] Field of Search ..... 219/756, 757, 219/738, 746; 126/273 R

[56] References Cited

U.S. PATENT DOCUMENTS

| | | | |
|---|---|---|---|
| 4,609,801 | 9/1986 | Spencer et al. | 219/756 |
| 5,818,017 | 10/1998 | Ye et al. | 219/756 |

FOREIGN PATENT DOCUMENTS

| | | | |
|---|---|---|---|
| 60-263020 | 12/1985 | Japan | 219/757 |
| 61-262525 | 11/1986 | Japan | 219/757 |
| 62-10515 | 1/1987 | Japan | 219/756 |

*Primary Examiner*—Philip H. Leung
*Attorney, Agent, or Firm*—Ostrolenk, Faber, Gerb & Soffen, LLP

[57] ABSTRACT

A microwave oven includes a cavity formed by a plurality of plates with inner surfaces thereof forming a cooking chamber, outer surfaces of the plates forming a casing of the microwave oven, a shielding plate forming a machine chamber underneath the cavity to provide therein a magnetron and a high voltage transformer, and a door attached to a side surface in the cavity and opening/shielding the cooking chamber to/from an exterior thereof. The microwave oven minimizes the size while maximizing the capacity of the cooking chamber, thereby decreasing the required plate number and production cost.

1 Claim, 3 Drawing Sheets

MICROWAVE OVEN MAIN BODY STRUCTURE

BACKGROUND OF THE INVENTION

1. Field of the Invention

The present invention relates to a microwave oven, and more particularly, to an improved microwave oven which increases a cooking chamber capacity thereof while minimizing the oven size.

2. Description of the Background Art

FIG. 1 is an exploded perspective view illustrating the composition of a conventional microwave oven, and FIG. 2 is a schematic cross-sectional view taken along line I–I' in FIG. 1 to show a cavity structure of the conventional microwave oven.

The conventional microwave oven includes a cavity 1 formed by a plurality of plates 3, 4, 5, 6. The cavity 1 is completed by covering an outer case 8.

The formation of the cavity 1 will now be described.

First, the front plate 3 is installed at the front part of the cavity 1. The back plate 4 is installed at the rear part of the cavity 1.

Also, the lower plate 5 is installed to form a lower surface and both side surfaces of the cavity 1. An upper plate 6 is provided to serve as a ceiling. A base plate 7 is provided to form a lower surface of the mechanical room is disposed underneath the lower plate 5 to thereby form a lower surface of a machine chamber 9.

The cooking chamber 2 formed in the interior of the cavity 1 has several unnecessary vacant spaces which serve to decrease the capacity thereof: one between the upper plate 6 forming the ceiling of the cooking chamber 2 and the outer case 8 forming the outer casing of the microwave oven; another the lower plate 5 forming the bottom surface of the cooking chamber 2 and the base plate 7; and still another between a side surface of the lower plate 5 and a side surface of the outer case 8.

Although a turntable rotating motor (not shown) or an additional heater (not shown) can be furnished in such vacant spaces as described above, most of the spaces are left over unemployed.

As described above, the conventional microwave oven has a disadvantage in that the size of the microwave oven tends to be unnecessarily large when compared to the capacity of the cooking chamber formed within the cavity.

SUMMARY OF THE INVENTION

The present invention is directed to overcoming the conventional disadvantages.

Therefore, it is an object of the present invention to provide a microwave oven which increases a cooking chamber capacity thereof while minimizing the oven size.

To achieve the above-described object, there is provided a microwave oven according to the present invention which includes a cavity formed by a plurality of plates with inner surfaces thereof forming a cooking chamber, outer surfaces of the plates forming a casing of the microwave oven, a shielding plate forming a machine chamber underneath the cavity to provide therein a magnetron and a high voltage transformer, and a door attached to a side surface in the cavity and opening/shielding the cooking chamber to/from an exterior thereof.

The object and advantages of the present invention will become more readily apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

With reference to the accompanying drawings, the microwave oven according to the present invention will now be described.

Figure 1:
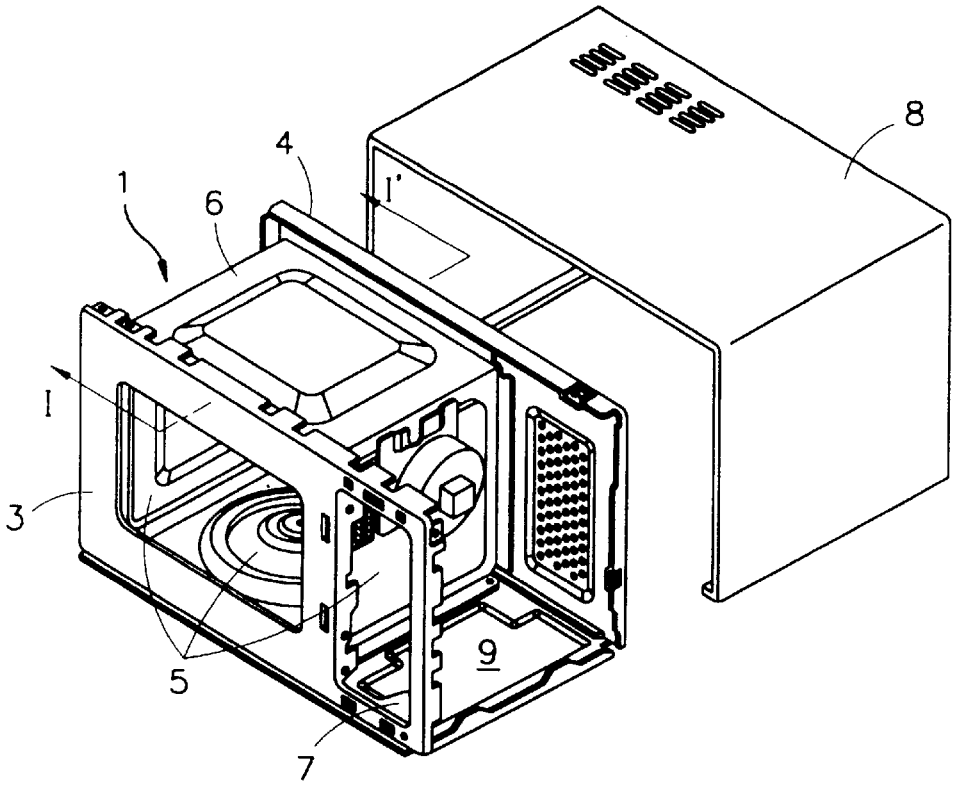
FIG. 1 CONVENTIONAL ART
FIG. 1 is an exploded perspective view illustrating the construction of a conventional microwave oven.
Figure 2:
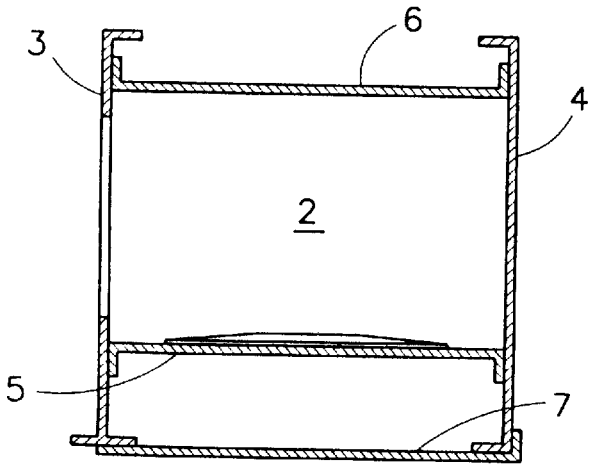
FIG. 2 CONVENTIONAL ART
FIG. 2 is a cross-sectional view taken along line I–I' in FIG. 1 according to the conventional microwave oven.
Figure 3:
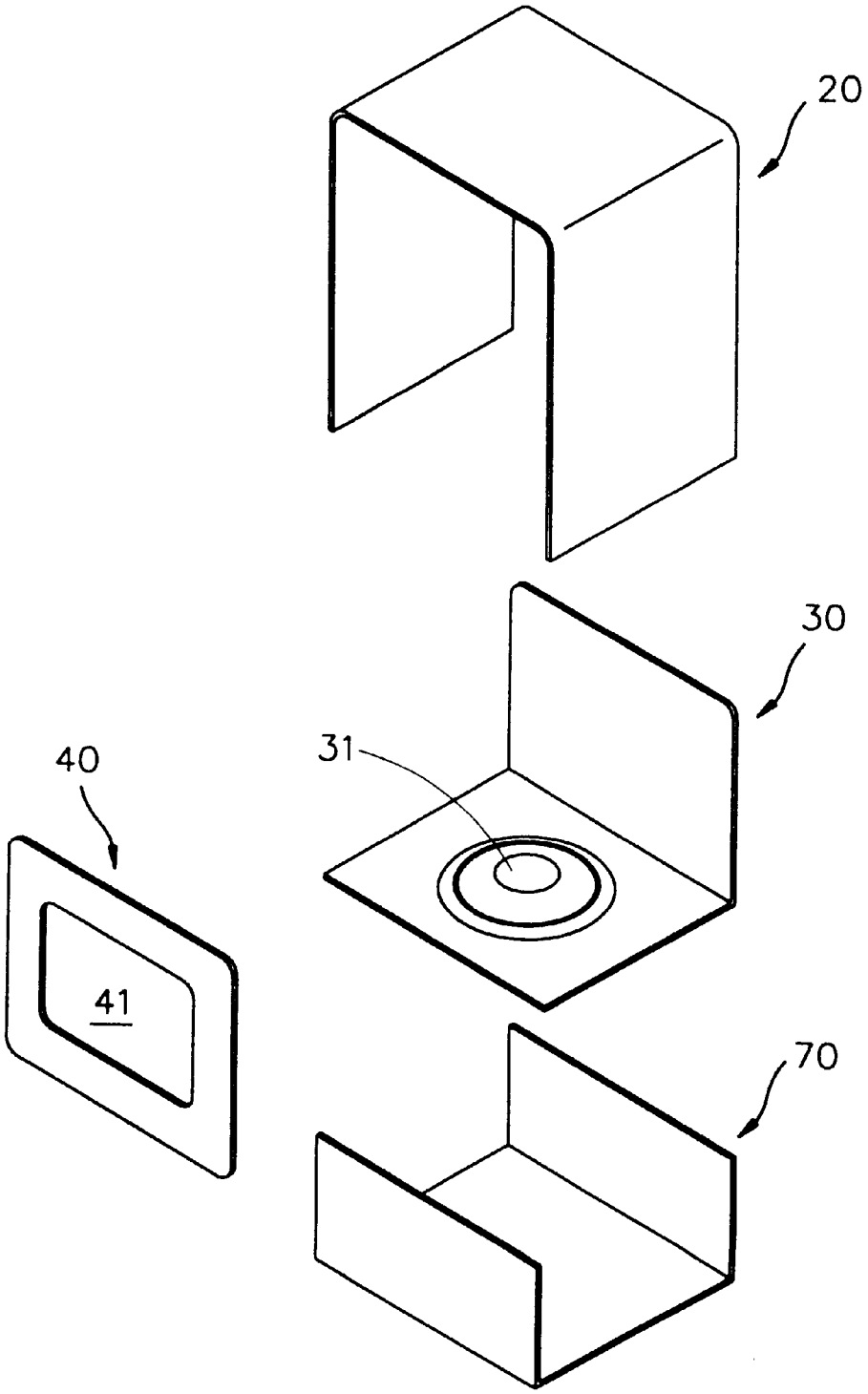
FIG. 3 is an exploded schematic perspective view illustrating a cavity construction of a microwave oven according to the present invention.
Figure 4:
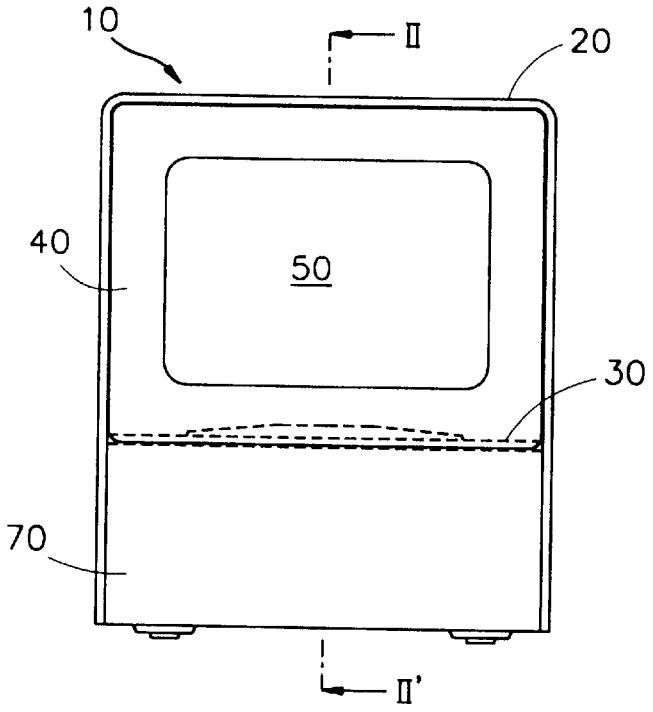
FIG. 4 is a schematic front view illustrating the cavity construction of the microwave oven according to the present invention.
Figure 5:
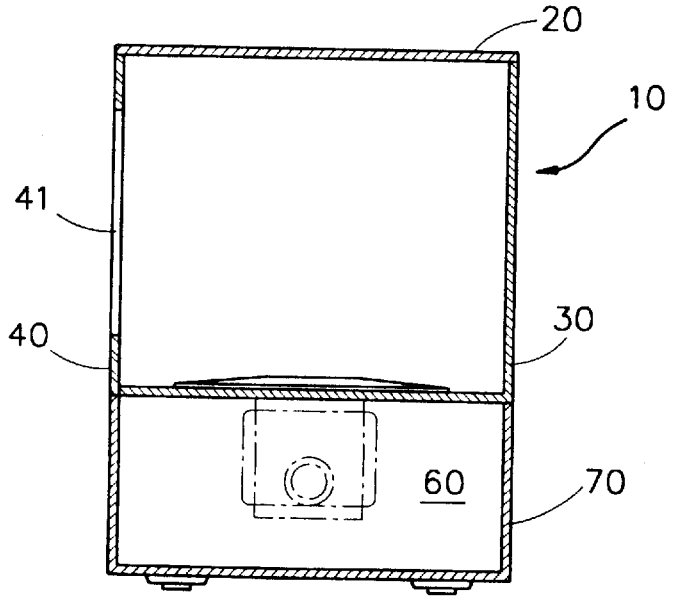
FIG. 5 is a schematic cross-sectional view taken along line II–II' in FIG. 4 according to the present invention.

FIG. 3 is an exploded schematic perspective view illustrating a cavity construction of a microwave oven according to the present invention, FIG. 4 is a schematic front view illustrating the cavity construction of the microwave oven according to the present invention, and FIG. 5 is a schematic cross-sectional view taken along line II–II' in FIG. 4 according to the present invention.

As shown therein, a cavity 10 of the microwave oven according to the present invention is formed with the provision of respective plates 20, 30, 40, while their inner surfaces are provided to form a cooking chamber 50. The respective plates 20, 30, 40 are also formed into an outer casing.

Specifically, the upper plate 20 serves as the upper surface and both side surfaces of the chamber 50 while forming the upper and both side surfaces of the outer casing.

That is, the inner surfaces of the upper plate 20 form the ceiling and both side walls of the cooking chamber 50, and the outer surfaces of the upper plate 20 form the upper surface and both side surfaces of the microwave oven.

The lower plate 30 forms the bottom surface and the rear surface of the chamber 50.

Also, the inner surfaces of the lower plate 30 serve as the bottom surface and the rear surface of the cooking chamber 50, and the outer surfaces thereof respectively serve as the upper surface of the machine chamber 60 and an outer rear surface of the microwave oven.

The machine chamber 60 includes mechanical parts such as a magnetron and a high voltage transformer, and it is shielded from an exterior by a U-shaped shielding plate 70 which forms the bottom and rear surface of the microwave oven.

Meanwhile, the front plate 40 is attached to the front surface of the upper plate 20, and a window 41 is attached to the front plate 40 so as to be opened/closed via a door (not shown).

The door (not shown) is attached to the front plate 40 to open/close the window 41 provided at the front plate 40.

The inner surface of the front plate 40 forms the front surface of the cooking chamber 50.

Here, reference numeral 31 denotes a microwave discharger.

According to the construction of the present invention, the plates 20, 30, 40 forming the cavity 10 are assembled into the chamber 50 and at the same time into the external case of the microwave oven.

Therefore, the present invention eliminates the spaces conventionally formed between the cavity and the casing, whereby the entire size of the microwave oven becomes decreased and accordingly the cooking chamber capacity relatively becomes increased.

Further, since the plates 20, 30, 40 forming the cavity 10 serve as the casing of the microwave oven according to the present invention, the number of required plates is decreased, thereby realizing cost reduction and simplifying the manufacturing process and accordingly lowering the price of products.

Still further, the present invention minimizes the size while maximizing the capacity of the cooking chamber 50 so as to be appropriate to a low capacity microwave oven.

As described above, the microwave oven according to the present invention has the respective plates forming the inner surfaces of the cavity while serving as the casing thereof, so that the capacity of the cooking chamber can be provided large in comparison to the size of the microwave oven, thereby decreasing the required plate number and production cost.

As the present invention may be embodied in several forms without departing from the spirit of essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within meets and bounds of the claims, or equivalences of such meets and bounds are therefore intended to embrace the appended claims.

What is claimed is:

1. A microwave oven main body structure formed of only four structural pieces, comprising:

a cavity defined by a plurality of plates having inner surfaces which form a cooking chamber and outer surfaces which form a casing of the microwave oven;

a U-shaped shielding plate forming a machine chamber underneath the cavity to hold therein a magnetron and a high voltage transformer; and a door attached to a side surface in the cavity, for opening/shielding the cooking chamber to/from an exterior thereof, wherein the cavity comprises:

an upper plate having inner surfaces which form an upper surface and both side surfaces of the cooking chamber and having outer surfaces which form an upper surface and both side surfaces of the casing of the microwave oven;

a lower plate having inner surfaces which form a bottom surface and a rear surface of the cooking chamber and having outer surfaces which form an upper surface of the machine chamber and a rear surface of the casing of the microwave oven; and a front plate fixed at a front opening of the front plate, the door being attached thereto.

* * * * *